United States Patent [19]

Thomson

[11] 4,093,848

[45] June 6, 1978

[54] TOY CASH REGISTER CONSTRUCTION

[75] Inventor: James E. Thomson, Pleasant Lake, Mich.

[73] Assignee: Western Stamping Corporation, Jackson, Mich.

[21] Appl. No.: 677,928

[22] Filed: Apr. 19, 1976

Related U.S. Application Data

[63] Continuation-in-part of Ser. No. 501,166, Aug. 28, 1974, Pat. No. 3,957,198.

[51] Int. Cl.[2] ..... G07G 1/00; G06C 27/00

[52] U.S. Cl. ..... 235/1 E; 235/22

[58] Field of Search ..... 235/1 E, 22, 12, 128; 46/39, 2

[56] References Cited

U.S. PATENT DOCUMENTS

| | | | |
|---|---|---|---|
| 964,026 | 7/1910 | Jacobs | 235/1 E |
| 3,870,864 | 3/1975 | Brandstatter | 235/1 E |

FOREIGN PATENT DOCUMENTS

| | | | |
|---|---|---|---|
| 617,803 | 2/1949 | United Kingdom | 235/1 E |

*Primary Examiner*—Stephen J. Tomsky

*Attorney, Agent, or Firm*—Harness, Dickey & Pierce

[57] ABSTRACT

A toy cash register including, in one embodiment, a plastic case having a drawer compartment at the bottom and main mechanism and target display compartments above the drawer compartment. A horizontal metal frame plate defines the top of the drawer compartment and the bottom of the main mechanism compartment. The targets and their operating and release mechanism are supported on the top of the metal frame plate by a plastic target frame carried thereby. In one embodiment a bell and clapper are supported by the target frame below the metal plate and above a cash drawer slidable in the bottom compartment. In another embodiment the bell and clapper are located under the drawer. The means for opening the drawer consists of a wire spring formed as a simple loop of generally circular form which reacts outwardly against the drawer and inwardly against the case. In one embodiment the spring is carried by the case, and in another embodiment by the drawer. The drawer is guided by a portion of its operating mechanism.

21 Claims, 23 Drawing Figures

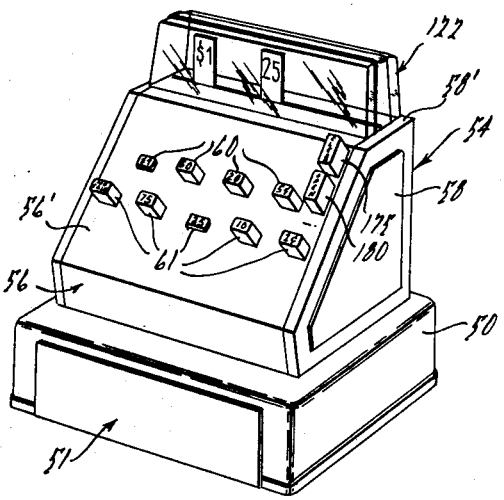
FIG. 1.
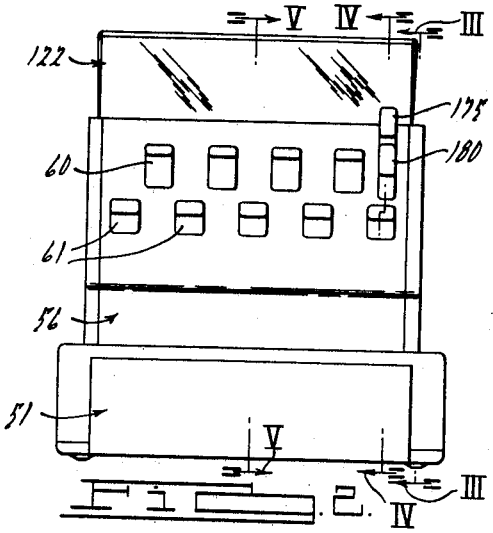
FIG. 2.
FIG. 3.
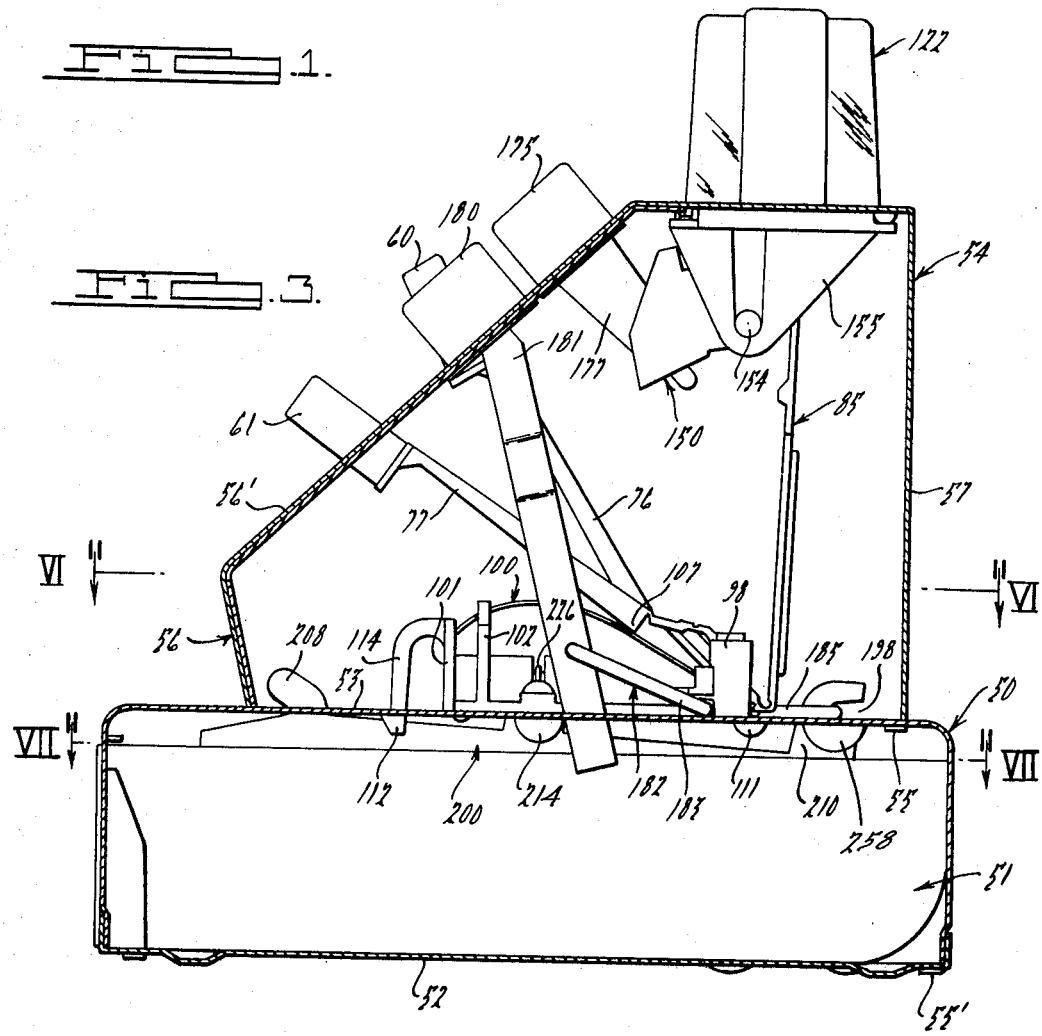

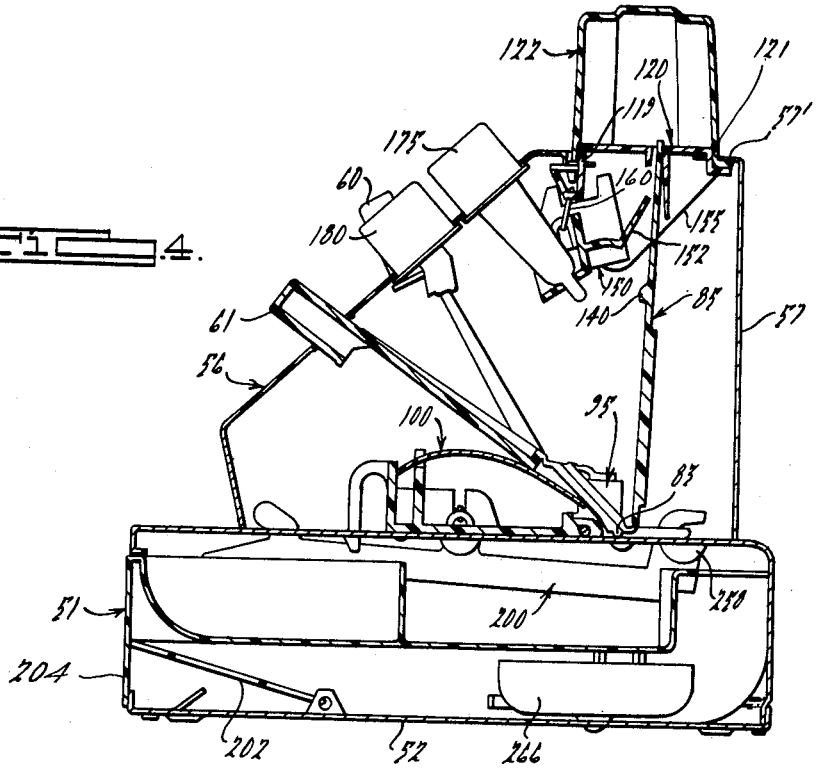
FIG. 4.
FIG. 5.
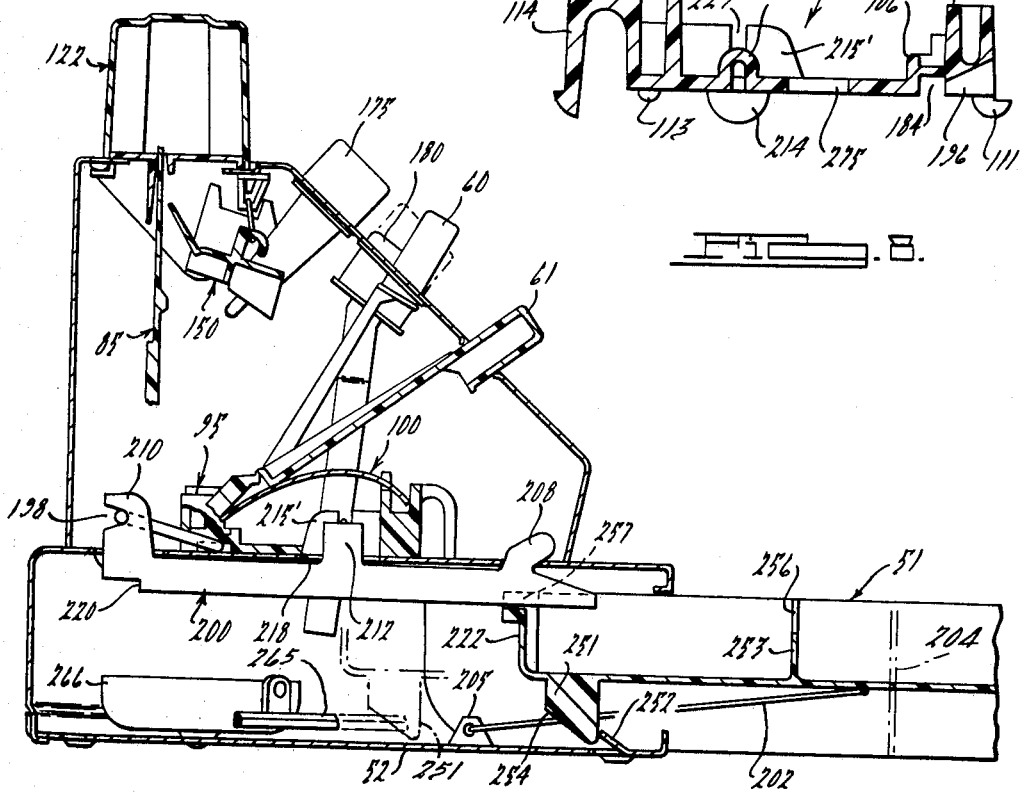
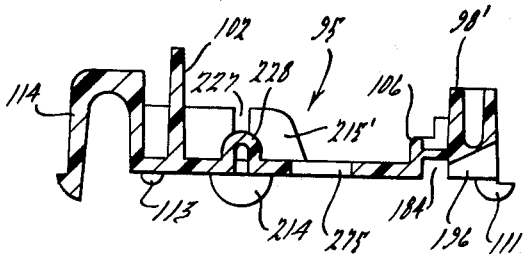
FIG. 8.

FIG. 11.
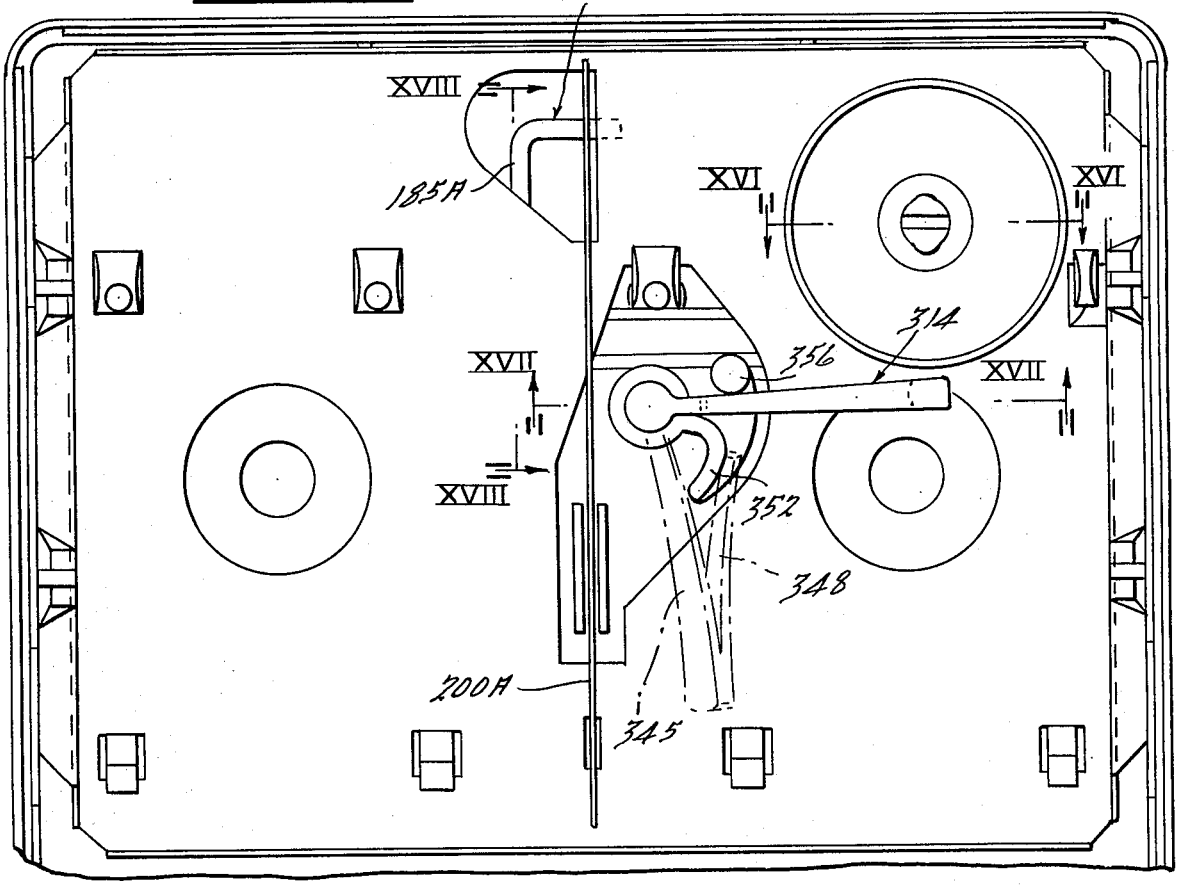
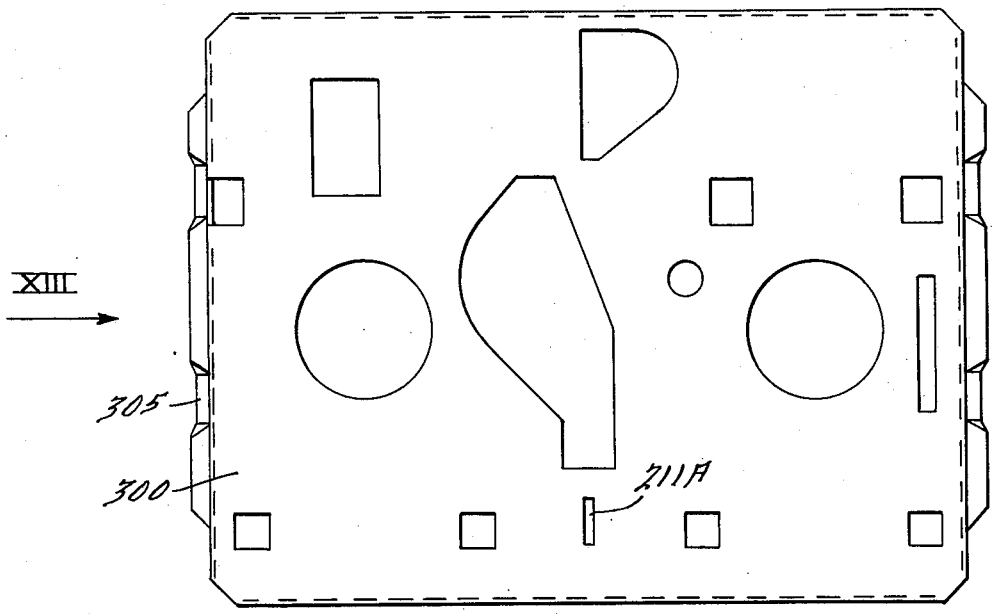
FIG. 12.
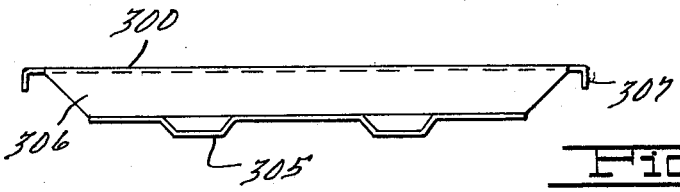
FIG. 13.

TOY CASH REGISTER CONSTRUCTION

REFERENCE TO PRIOR COPENDING APPLICATION

The present application is a continuation-in-part of copending application Ser. No. 501,166, filed Aug. 28, 1974, now U.S. Pat. No. 3,957,198, granted May 18, 1976.

BACKGROUND OF THE INVENTION

It is the overall objective of the present invention to further improve and simplify the construction of toy cash registers of the type disclosed in the above-mentioned copending application and to enable the manufacture thereof even more economically, so that these educational toys can be sold at lower prices and thus be made available to more children who can enjoy and benefit from playing with such devices which are of an intriguing character but which help to familiarize them with numbers.

More specifically, the present invention enables the use of a unitary plastic case rather than a metal case, in a manner which simplifies assembly, an improved drawer construction of greater capacity but which does not utilize any more material or occupy any more space, an improved, simplified and lower-cost drawer-actuated clapper and bell mechanism, and an improved drawer-projecting spring and stop arrangement. These improvements reduce the cost of construction and also the weight of the finished assembly, so that savings in overall cost to the consumer result both from lower manufacturing costs and from lower cost of shipment.

Other features, objects and advantages will become apparent upon consideration of the present disclosure in its entirety.

BRIEF DESCRIPTION OF THE FIGURES OF DRAWING

FIG. 1 is a perspective view of a toy cash register incorporating the present invention;

FIG. 2 is a front elevational view thereof;

FIG. 3 is a sectional elevational view thereof on a larger scale taken substantially on the line III—III of FIG. 2 and looking in the direction of the arrows;

FIG. 4 is a sectional elevational view on an intermediate scale taken substantially on the line IV—IV of FIG. 2, and looking in the direction of the arrows;

FIG. 5 is a sectional view taken substantially on the line V—V of FIG. 2 and looking in the direction of the arrows, showing the cash drawer projected and partially broken away;

FIG. 8 is a cross sectional view of the target frame, separated from the other parts but taken at the position designated by the line and arrows VIII—VIII in FIG. 6;

FIG. 11 is a bottom plan view, with the bottom plate and drawer removed and a front portion broken away;

FIG. 12 is a top plan view of the frame plate;

FIG. 13 is a side elevational view of the frame plate, taken as indicated by the arrow designated XIII in FIG. 12;

DETAILED DESCRIPTION OF PREFERRED FORMS OF THE INVENTION

Figure 6:
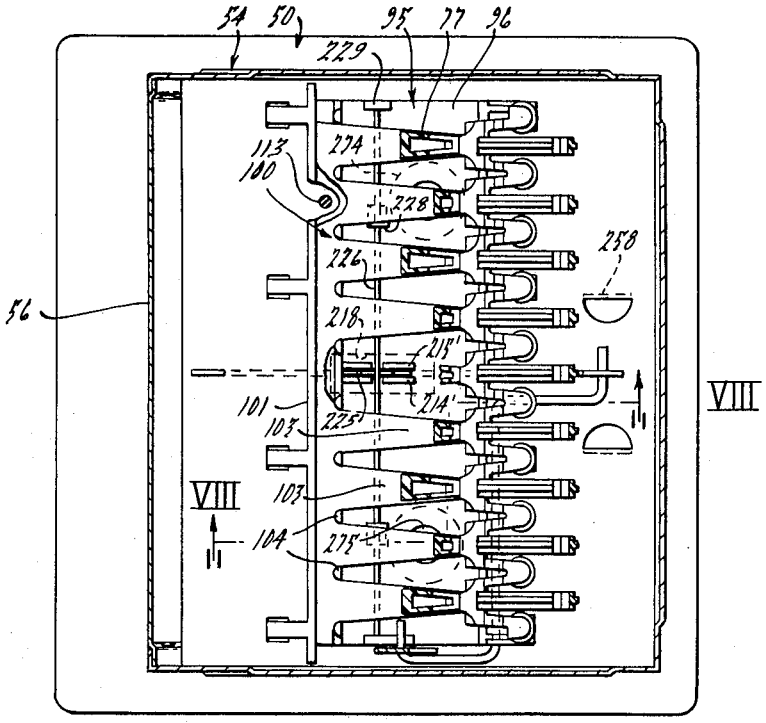
FIG. 6 is a sectional plan view taken substantially on the line VI—VI of FIG. 3 and looking in the direction of the arrows, a portion being broken away.

The construction of the cash register shown in FIGS. 1–8 inclusive is fully disclosed in my copending application Ser. No. 501,166, filed Aug. 28, 1974. The sheet metal case consists of a base portion 50 which defines a compartment for the drawer, bell, clapper, drawer latch and related parts, and an upper section 54, the sloping front wall portion 56' of which defines a keyboard section. The drawer 51 is slidable between the closed position shown in FIG. 3 and the open position shown in FIG. 5. Pushbutton-type keys 60 and 61 operate individual display target members 85 which slide up and down through a target guide 120 and when elevated are latched up in displayed position inside transparent cover-window member 122 by a rockable latch member 150 having fingers 152 underengageable with latching abutments 140 on the targets. A release button 175 is provided, the actuation of which rocks the latch member and its fingers 152 away from the target abutment thereby permitting the targets to drop. A spring 160 normally maintains the latch member in the position which yieldably holds the fingers close enough to the targets to underlie the abutment portions of those which are raised.

The individual fingers 103 of a comb-type leaf spring 100 exert a retracting bias on the targets and a projecting bias on the pushbuttons 60, 61. All of the pushbuttons 60 and 61 are formed integrally with one another and with all of the targets 85, and the unitary pushbutton-target assembly is supported in a molded plastic target frame member 95 attached to the sheet metal top wall 53 of the base 50. Details of the construction and operation of the targets and target release means do not form a part of the present invention and are disclosed in said prior application Ser. No. 501,166.

The keyboard section 56' also carries a button 180, the depression of which releases a drawer latch. Pushbutton 180, mounted in an (undesignated) suitably-positioned opening in the keyboard section 56', has attached thereto a plunger 181, the lower extremity of which projects through and is guided by a slot (undesignated) in the top wall 53 of the base 50. A crank, generally designated 182, is rockably supported in a downwardly-opening slot 184 in the bottom of the target frame 95 and has one arm 183 pivoted in the lower portion of the plunger 181 and a second arm 185 which projects rearwardly from the frame 95 through and is vertically movable in a slot 196 in a socket portion, designated 98' in FIG. 8 which is one of a series of socket portions formed in the target frame, the others of which are designated 98, and all of which act as supports for the pushbutton-target assembly. Crank 182 is hooked in a slot 198 in a drawer latch arm generally designated 200.

Figure 7:
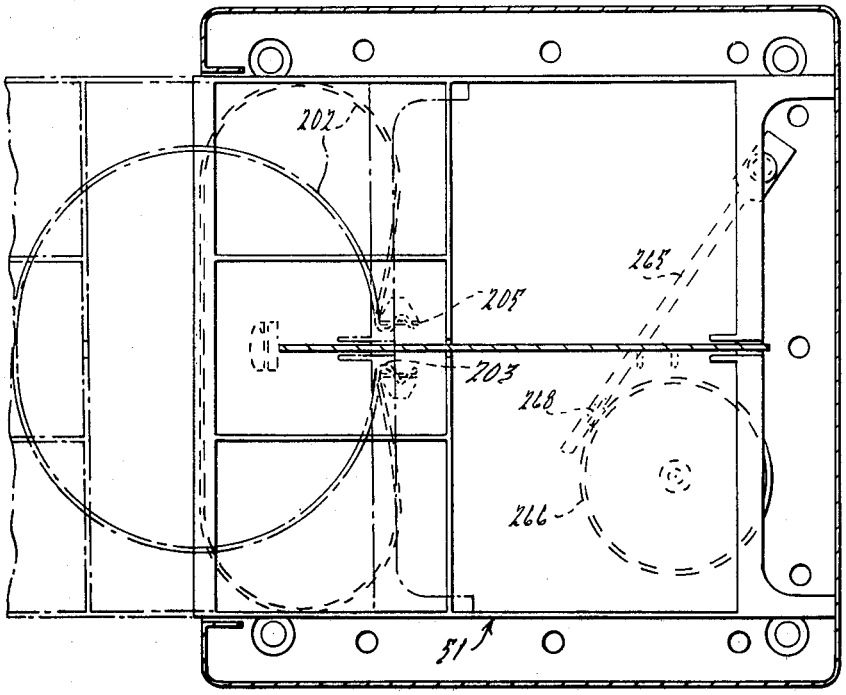
FIG. 7 is a sectional plan view taken substantially on the line VII—VII of FIG. 3 and looking in the direction of the arrows, the projected positioning of the drawer and related portions being indicated in broken lines.

The drawer 51 is biased outwardly by a wire spring 202 which is initially straight but looped to substantially circular shape and which when the drawer is closed is distorted to oval shape, as shown in dotted lines in FIG. 7, by the depending front wall 204 of the drawer. The spring 202 lies beneath the drawer and has its two spaced rear ends hooked into and retained by tongues 205 struck up from bottom plate 52. The tongues 205 have front edges which incline rearwardly at approximately 60° toward the top, and the hooked ends 203 of spring 202 are of generally S-shape, as shown in FIG. 7. The expansive force of the spring causes the parts thereof near the S-bends, which parts are forced against the inclined front edges of the tongues 205, to exert a cam-like force urging the spring to and holding it in an upwardly inclined position, as nearly perpendicular to the inclined edges as possible. The spring is thereby kept in effective engagement with the drawer and prevented from dropping to a position such that it might project out underneath the drawer front.

The drawer latch arm 200 comprises a flat sheet metal member lying on a central vertical plane and extending toward the front and rear of the assembly beneath the top wall 53 of the base. Near its forward end the latch arm has an upwardly and forwardly inclined tongue 208 hooked in a slot (undesignated) in wall 53. The juncture of tongue 208 with the straight bottom portion of the latch arm 200 defines a pivot for vertical swinging movement of the arm. The rear end of the latch arm has an upwardly extending tongue 210 which extends through and is guided in a slot in the wall 53 and is notched at 198 to receive the crank arm 185. A mid portion of the latch member 200 has an integral tongue 212 which extends upwardly through a slot-like opening 225 between two laterally spaced downwardly projecting flanges 214, 215 integral with frame 95, and through upwardly extending coplanar continuation flanges 214', 215', also integral with target frame 95. The downwardly extending flanges 214, 215 project through an opening 218 in wall 53, and coact with the flanges 214', 215' to define slide bearings for the sheet metal latch arm 200 and its portion 212. The latch arm is thereby effectively held against substantial lateral movement and accurately guided in its vertical movement. In FIG. 6 the central one of the spring 35 103 is broken away to show the positioning of flanges 214', 215' and 40 the aperture 218. A shoulder 220 on the rear of the latch arm 200 is movable vertically to and from an interfering position with the rear wall 222 of the drawer 51 by rocking movement of the latch member in a vertical plane around the pivot axis defined by the front tongue 208.

The flanges 214', 215' extend upwardly to a position higher than that occupied by the top edge of the tongue 212. A transverse slot 227 extends downwardly through flanges 214', 215', intersecting slot 225. A wire spring member 226, which is straight when relaxed, is arched over the top edge of the tongue 212 within the slot 227, and is confined by looped retainers 228 and abutment flanges 229 formed on the target frame 95. Spring 226 biases the rear end of the latch down to the drawer-holding position, and the pushbutton 180 to the raised position. As the drawer is moved to the closed position, the latch arm, which has a straight lower edge, is cammed upwardly by the rear wall 222 of the drawer, and when the drawer reaches the fully-closed position the rear of the arm moves downwardly so that the shoulder 220 then retains the drawer in the closed position. Outward movement of the drawer is limited by an abutment tongue 251 depending integrally from the bottom of the drawer. The drawer is also formed as a unitary molded plastic member. A tongue 252 struck up from the bottom plate 52 blocks the abutment 251 to limit the projection of the drawer. The drawer is provided with a transverse central partition 253. The partition 253 and rear wall 222 are provided with aligned vertical slots 256, 257, respectively, which are narrow and of a width to just slidably receive the latch arm 200. The latch arm thus serves as a guide to center the drawer in the front drawer opening. Rounded hold-down tongues 258 struck downwardly from wall 53 and positioned to overlie and prevent upward movement of the back wall 222 of the drawer insure proper disengagement of the latch bar when button 180 is depressed.

When the drawer is fully closed, the abutment 251 which has an inclined rear edge 254 lies to the rear of a spring striker or clapper arm 265, for a bell 266. The clapper arm and bell are riveted to the top of bottom plate 52 under the raised bottom of the drawer. The clapper arm is formed of a resilient material such as a suitable acetal plastic having spring characteristics, an example of which is du Pont "Delrin." In moving forwardly, the abutment 251 moves the clapper arm 265 forwardly until the abutment slides past the free end of the clapper arm, which then moves rearwardly, under the spring effect of its own resiliency, and a metal button 268 thereon strikes the bell.

It will be noted that the ears 205 which secure the ends of the looped drawer spring 202 are spaced on either side of the centerline, so that the abutment 251 can move between them, to and from engagement with the abutment 252. The spring 202 reaches the limit of its expansion before the drawer reaches the fully-open position, but the inertia of the drawer carries it to the fully-open position. The position and length of the clapper arm 265 are such that the abutment 251 moves free of the clapper arm while the spring is exerting power on the drawer, or close to the limit of expansive movement of the spring.

In the modified construction shown in FIGS. 9–23 inclusive, many parts corresponding to those already described are designated by like reference characters distinguished by the addition of the letter A, and will require no redescription. In such modified construction the case 65 is formed as a unitary plastic open-bottomed box member molded of styrene or other suitable plastic including an upper portion 54A defining a mechanism compartment, the front wall 56A of which is curved to generally partly cylindrical form and defines a keyboard section within which the target actuating pushbutton keys 60A, 61A are supported and slidable to actuate the targets 85A. The construction and arrangement of actuating parts are similar to those referred to above and disclosed in greater detail in the aforementioned application Ser. No. 501,166. The target release mechanism is also constructed in the same manner as disclosed in said prior application and is actuatable by the target release button 175A.

Figure 9:
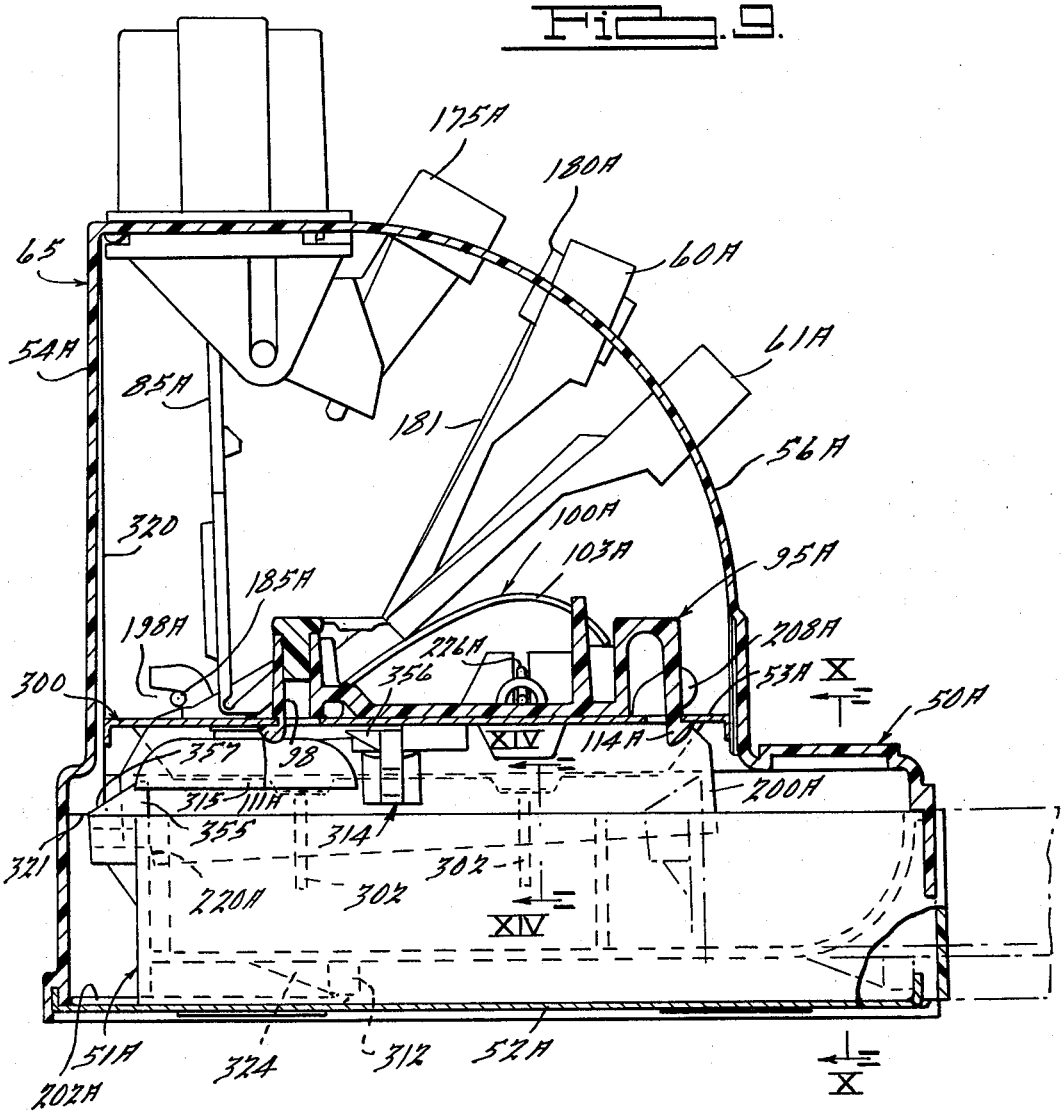
FIG. 9 is a vertical sectional elevational view of a toy cash register of a modified construction, taken on a plane close to the left side wall and looking to the right, substantially at the position indicated by the line and arrows IX—IX in FIG. 10.
Figure 10:
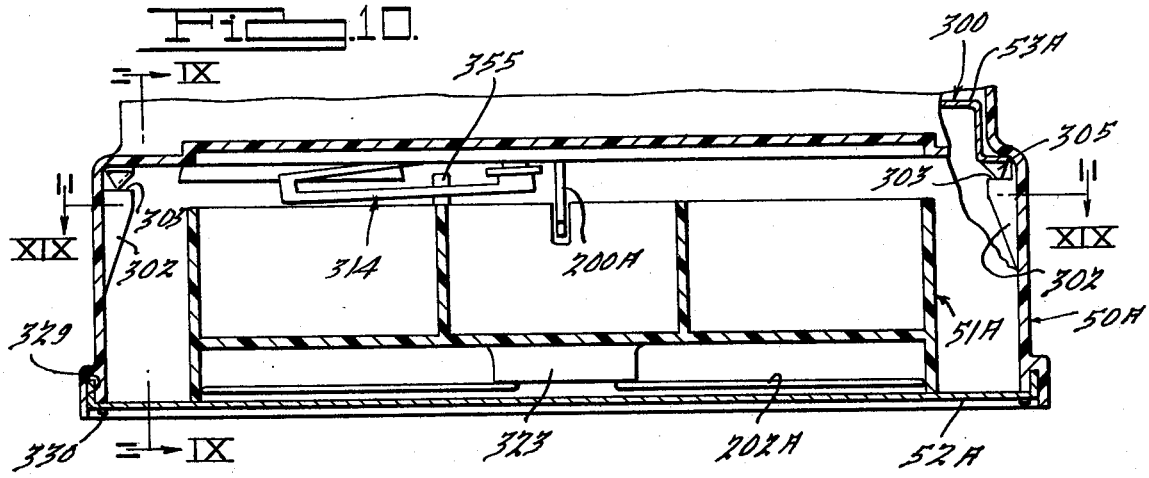
FIG. 10 is a fragmentary sectional view taken substantially on the line X—X of FIG. 9 and looking in the direction of the arrows.
Figure 14:
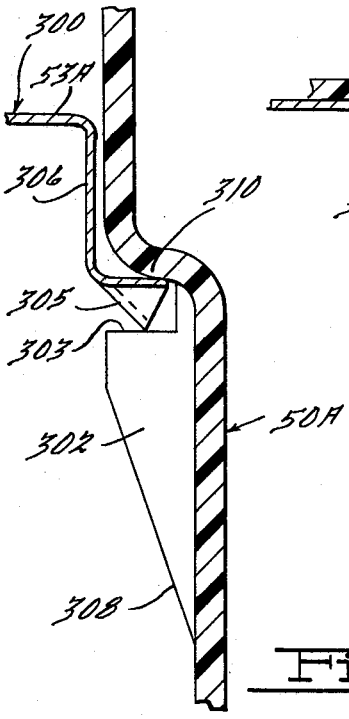
FIG. 14 is a sectional detail on an enlarged scale of a portion at the right side taken substantially at the position indicated by the line and arrows XIV—XIV in FIG. 9 and looking in the direction of the arrows, showing the interconnection between the frame plate and the case.

It will be observed that the base portion 50A of the case has side, front and rear walls which are formed as integral extensions of the upper section 54A, and define a drawer compartment, and that the horizontal wall 53A which carries the target frame 95A is formed as a part of a separate sheet metal frame plate member 300. The construction of the frame plate 300 is best shown in FIGS. 12 and 13. The side walls of the base section 50A of the case are spaced somewhat farther apart than the side walls of the upper section 54A, and within the drawer compartment, at a position near the top, a plurality of inwardly projecting integral ribs 302 are provided, two on each side and spaced to provide four-point support for the frame plate 300 (see FIG. 14). Each rib 302 has at its top a horizontal shoulder 303 defining a support for one of the four outwardly and downwardly bent flange portions 305 formed at opposite sides of the frame plate as extensions of vertical side wall portions 306 which, as best shown in FIGS. 9, 10 and 14, support the horizontal wall portion 53A of frame plate 300 at a suitable position spaced slightly above the drawer compartment. The side walls 306 of the frame plate are flexible inwardly, and the downwardly extending inner edges 308 of the supporting ribs 302 are inclined outwardly toward the bottom. The vertical spacing between the top edges 303 of the ribs 302 and the inwardly extending shoulder 310 formed by the inset disposition of the side walls of top section 54A define areas which receive and confine the supporting flange portions 305 which, as shown in FIGS. 12–14, are bent from the side walls 306, the side walls 306, however, being separate, at their ends, from the front and rear flange-walls 307 of the frame plate 300, so that the side walls and the flange portions 305 carried thereby can flex inwardly to enable insertion of the frame plate from the bottom by snapping it into place.

Figure 15:
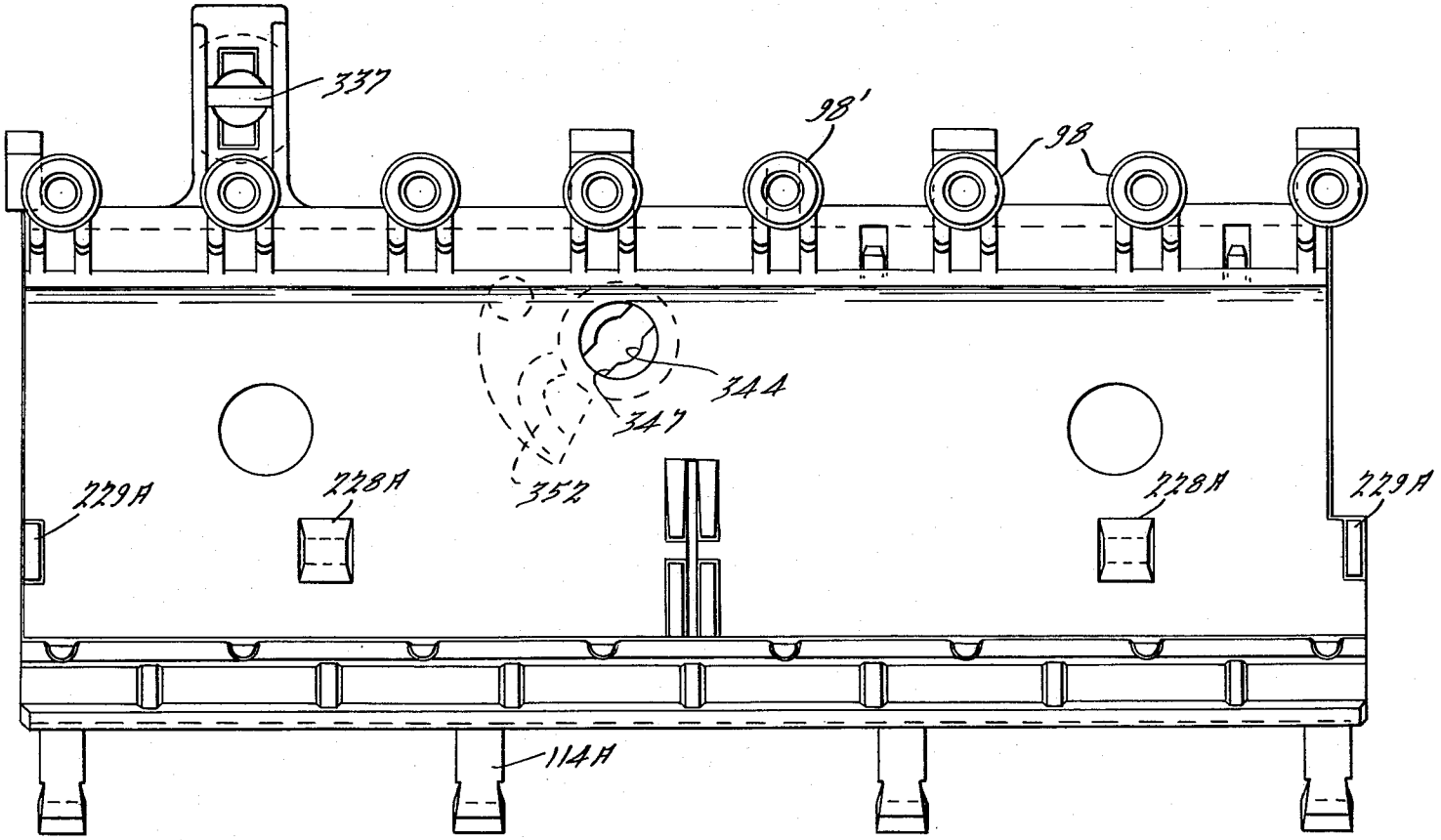
FIG. 15 is a plan view of the target frame.

The metal frame plate 300 and molded plastic target frame 95A define a partition between the drawer compartment and the mechanism compartment. The construction of the target frame, which directly supports virtually all of the operative parts, is best shown in FIGS. 9 and 15. Although in the first embodiment nine targets and actuating keys 60, 61 are provided, it will be observed that the target frame of the modified embodiment is designed to accommodate only seven keys and targets. This is of course a matter of choice on the part of the designer. In the construction illustrated it was done in order to enable the use of larger pushbuttons, which are easier of operation by smaller children. The construction and operation of the supporting portions of the target frame, targets, etc., will nevertheless be recognized as conforming to the disclosure of the prior patent application and will not require redescription, except as to the means integrated with the target frame, in this embodiment, for supporting the bell and clapper, which parts will be considered in detail hereinafter.

The front wall of the base section 50A of the case has a rectangular opening (undesignated) somewhat narrower transversely than the full width of the base section and slightly wider than the drawer 51A, which is slidable therethrough. The drawer rests on a bottom plate 52A and is guided in its movements by a sheet metal latch bar 200A, the construction and arrangement of which are similar to those of the latch bar 200 of the first-described embodiment. The latchbar has a supporting pivot portion 208A which supports it in similar fashion in a slot 211A in the frame plate, while at its rear end the latch bar extends upwardly and is shaped to define a hook-like opening 198A for the crank arm 185A of the actuating crank member 182A which is arranged and operable similarly to the crank member 182 of the first-described embodiment to lift the latch bar free of holding engagement with the rear wall of the drawer when the key 180A is depressed, whereupon the drawer is projected to the open position by the spring 202A.

The spring 202A is formed of a length of spring wire which is initially straight except for a short right angle bend at each end. The wire is of such length that when it is looped to substantially circular form and its bent ends are inserted into laterally spaced downwardly opening socket holes 313 formed in integral boss-like projections 312 on the bottom of the drawer (see FIGS. 19–21) the spring will be retained by and lie flat against the top of the bottom plate 52A, as shown in FIGS. 9 and 10, extending rearwardly to the back wall of the case and, when the drawer is closed, being distorted to a more nearly elliptical outline. Due to its tendency to reassume circular form, the spring urges the drawer outward. The force is sufficient to fully open the drawer and at the same time actuate a bell clapper 314 which, together with the bell 315, is hung above the drawer from the frame plate and target frame assembly.

The drawer is normally held closed by a notched portion 220A at the rear lower extremity of latch member 200A and which projects downwardly in front of the back wall 222A of the drawer until the latch member is lifted, against the effort of spring 226A, by actuation of key 180A. The latch member extends downwardly into slots 256A, 257A in the partition 253A and backwall 222A respectively of the drawer, and guides the drawer during its opening and closing movements as in the first embodiment. Along the top edge of its back wall 222A the drawer has a horizontal rearwardly projecting flange 318 which when the drawer is closed closely underlies the horizontal bottom edges 321 of ribs 320 formed on and projecting forwardly from the back wall of upper case portion 54A. The back end of the drawer is thereby prevented from rising with the latch member when the latter is lifted, thereby assuring release of the drawer.

Figure 19:
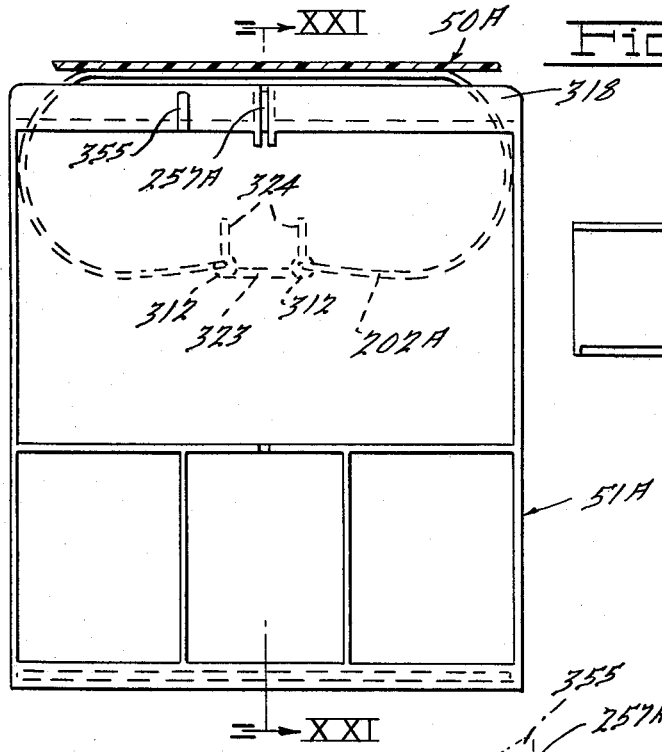
FIG. 19 is a sectional plan view taken substantially on the line XIX—XIX of FIG. 10 and looking in the direction of the arrows.
Figure 20:
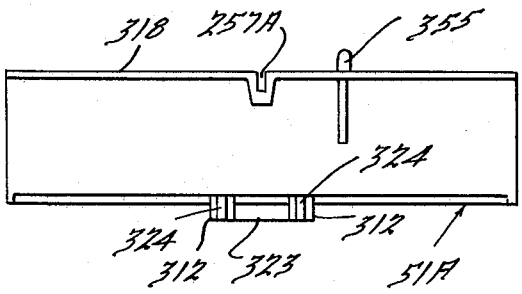
FIG. 20 is an elevational view of the back of the drawer.
Figure 21:
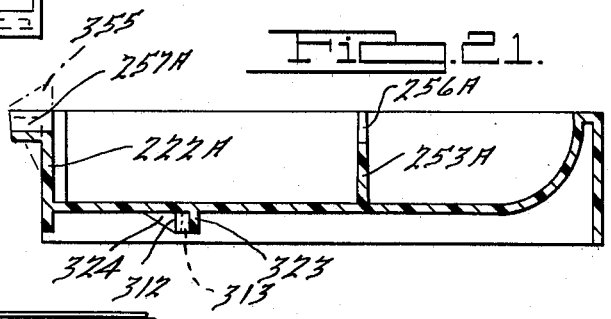
FIG. 21 is a sectional view of the drawer taken substantially as indicated by the line and arrows XXI—XXI of FIG. 19 and looking in the direction of the arrows.
Figure 22:
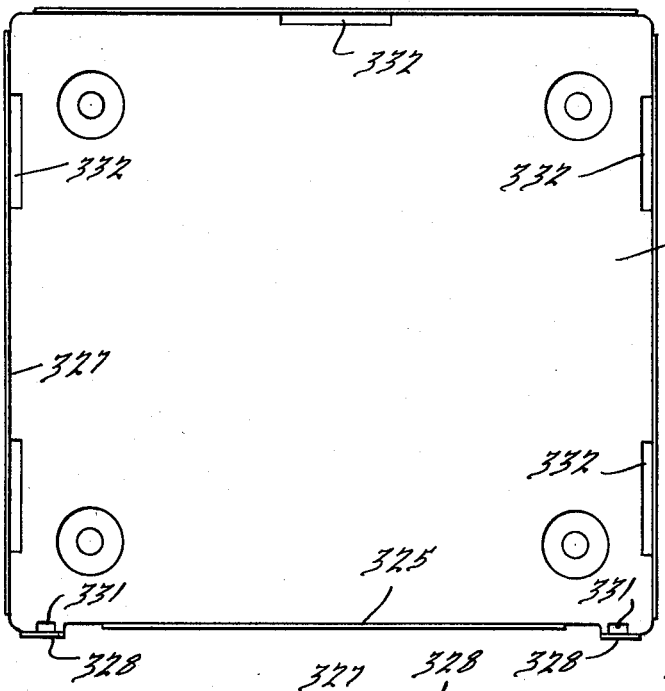
FIG. 22 is a top plan view of the bottom plate.
Figure 23:
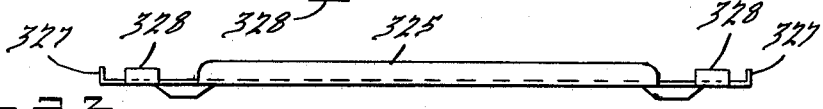
FIG. 23 is a front elevational view of the bottom plate.

The boss portions 312 which are spaced laterally from each other on the bottom of the drawer as shown in FIG. 19 are connected by a web wall 323 which is substantially tangent to both bosses at the front thereof. An inclined rib portion 324 integral therewith also extends rearwardly from each boss portion. Outward opening movement of the drawer is limited by engagement of the bosses and wall 323 with a flange 325 turned upwardly along the central portion of the front edge of the bottom plate 52A slightly to the rear of the plane of the drawer opening in the front wall of the case.

The bottom plate has upturned edge flanges 327, 328 which project upwardly into slots 329 in the bottom edges of the walls of the case to position the bottom plate and stiffen the walls of the case. The case has integral lug portions 330 which extend downwardly through slots 331, 332 in the bottom plate and are upset therebeneath by heat and deformation to retain the plate.

Figure 16:
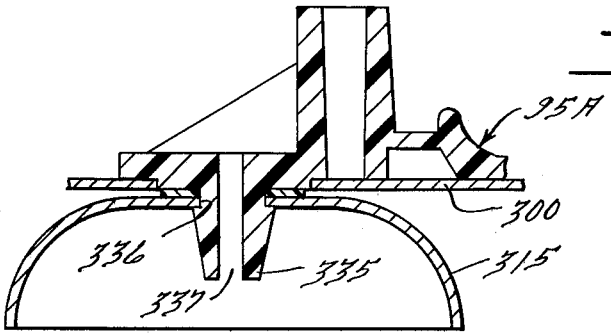
FIGS. 16, 17 and 18 are fragmentary sectional views taken substantially on the lines XVI—XVI, XVII—XVII and XVIII—XVIII of FIG. 11 and looking in the direction of the arrows, but with the parts shown upright rather than inverted as in FIG. 11.

The bell 315 is suspended beneath the frame plate 300 by means of a split boss 335 which is integral with and projects downwardly from the target frame 95A through an aperture (undesignated) in the frame plate 300 and an aperture in the center of the bell. The lower portion of the boss is of generally conical tapered form, an annular groove 336 being formed in the wall of the boss above the conically tapered lower portion. The parts are so proportioned, and the walls of the boss on either side of the slot 337 between the split halves are sufficiently flexible so that the bell can be pushed into place over the boss and into the groove 336 whereafter the two sides snap out and retain the bell as shown in FIG. 16.

The clapper, generally designated 314, is also suspended beneath the target frame 95A and frame plate 300 from an integral cuplike depressed boss 340 formed in the target frame. The clapper is formed of plastic which is relatively stiff but possessed of suitable spring characteristics, such as "Delrin," referred to previously, and is of generally U-shape, having a vertically disposed hub portion 342 which extends upwardly through and is rotatable on a vertical axis in an opening 344 in the bottom wall of the hollow boss 340. The opening 344 is substantially larger than the hub 342 to permit a limited amount of rocking of the clapper in vertical planes, for a purpose which will be explained. Extending laterally from and beneath the bottom of hub portion 342 is a generally horizontal supporting arm portion 345, the cross-sectional thickness of which is gradually increased toward its outer end or bight portion 346, which is thickened in all dimensions and which is positioned to strike the bell. Integral with the striker bight end portion 346 is a retroflex spring arm 348 which is tapered to decreasing thickness and which inclines upwardly and bears against the bottom of target frame 95A thereby urging the clapper downwardly and tending to augment the force of gravity and normally holding the clapper down in the full line position shown in FIG. 17. The free end portion 350 of arm 348 is engageable with and adapted when the clapper is swung away from the bell to be stressed by a curved abutment 352 which is also integral with and projects downwardly from the bottom of the target frame 95A.

A lug-type cam 355 projecting upwardly from the rear wall of the drawer is positioned to strike the lower arm 345 of the clapper as the drawer moves forwardly toward the open position and to ride along arm 345, swinging the clapper in a horizontal path from the position shown in full lines in FIG. 11 to the position shown in broken lines in that view during an initial portion of the opening movement of the drawer. It will be noted that the lug 355 is not tall enough to engage the upper or spring arm 348 of the clapper, and that, as shown in FIG. 11, the spring arm 348 is stressed by the wall 352 as the clapper is moved away from the bell toward the broken-line position. The lug 355 rides off the end of the clapper before the drawer reaches the fully-open position and while the drawer-projecting force of spring 202A is near its maximum, and the clapper is thereby released and is driven toward the bell by the spring arm 348. A stop abutment 356, also integral with and extending downwardly from the target frame 95A, tends to limit the movement of the clapper toward the bell, but the flexibility of the clapper is sufficient so that its bight portion strikes the bell when released in the indicated manner and immediately springs away, due to the presence of the abutment 356 so that the vibrations of the bell produce a clear ringing tone since there is no continuing contact and interference from the clapper.

Figure 17:
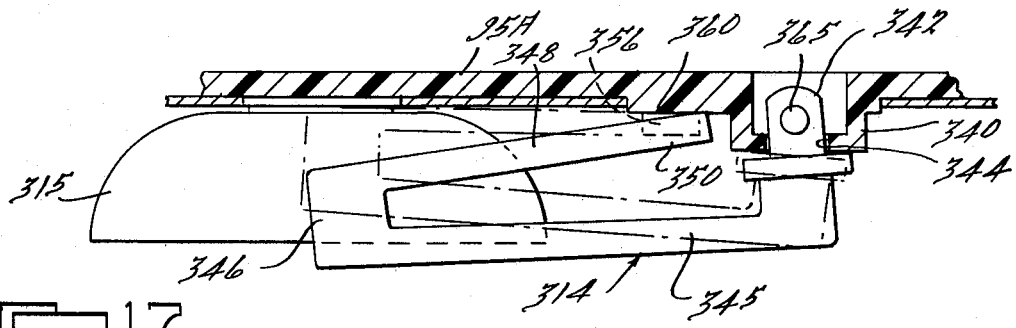
Figure 18:
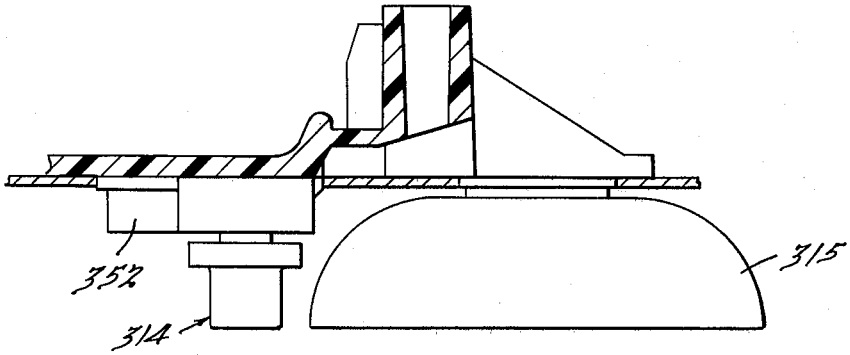

When the drawer is closed, the inclined rear wall 357 of the lug 355 rides under the lower arm 345 of the clapper, rocking the clapper up from its operative swinging path to the broken-line position shown in FIG. 17 so that the lug 355 may pass therebeneath to permit closing movement of the drawer. Thereafter the clapper is positively moved downwardly by arm 348 to the full-line position of FIG. 17 in which it can intercept the lug 355 when the drawer is opened.

The hub of the clapper is retained in the hollow boss 340 by integral lug portions 365 which project diametrically from the hub inside the boss. As shown in FIG. 15 the hole 344 in the bottom wall of the boss has integral diametrically opposed lateral extensions 347 which permit the lugs 365 to be passed therethrough with the hub portion 342 when the pawl is in an angular position which is not within its normal range of movement. The clapper is installed prior to the bell by turning the clapper to a position, which it cannot reach after the bell is installed, in which the lugs can be passed through the slot-like extension portions 347 of hole 344, and the clapper is then turned to its position shown in FIG. 11, wherein it extends between the stressing abutment 352 and the stop 356. At such time the lugs 365 are out of line with the lateral enlargements 347 and overlie the bottom wall of the boss 340 throughout the range of operative movement of the clapper, to retain the latter.

In assembling the parts, the unitary pushbutton-target assembly is first assembled with the target frame 95A, and with spring 100A, spring 226A, etc., and these parts are inserted from the bottom, with the case inverted and prior to the installation of the frame plate 300, the pushbuttons being projected through their respective holes in the keyboard section 56A and the targets projected into position in the target guide 120A. Thereafter the frame plate 300 is snapped into position and the target frame is pulled into tight engagement with the frame plate so that these parts become hooked together by the integral hook portions 111A, 114A on the target frame, hook portions 115A being yieldable laterally sufficiently to snap into overengaged holding relation with the frame plate through suitably positioned holes (undesignated) in the latter.

This Detailed Description of Preferred Forms of the Invention, and the accompanying drawings, have been furnished in compliance with the statutory requirement to set forth the best mode contemplated by the inventor of carrying out the invention. The prior portions consisting of the "Abstract of the Disclosure" and the "Background of the Invention" are furnished without prejudice to comply with administrative requirements of the Patent and Trademark Office.

What is claimed is:

1. In a toy cash register or the like having a pair of components which comprise a housing and a drawer horizontally slidable in the housing, means biasing the drawer to a projected relation with respect to the housing, characterized by an initially straight spring wire which tends to straighten when relaxed, said wire being looped to generally circular form and secured at its two ends to one of said components and reacting against but unsecured to the other, whereby it tends to return to circular form when distorted, said looped wire being arranged under the drawer and stressed to oval shape by the drawer and housing when the drawer is closed, said spring wire biasing the drawer to projected position due to the tendency of the wire to assume a circular shape.

2. A toy cash register or the like as defined in claim 1 wherein the end portions of said looped spring wire are at the rear and are secured to the housing and an intermediate unsecured forward portion thereof reacts against the drawer.

3. A toy cash register or the like as defined in claim 1 wherein the housing structure includes a bottom plate over which the drawer slides, the end portions of said looped spring wire being at the rear and being attached to said plate and an intermediate unsecured forward portion thereof reacting against the drawer.

4. A toy cash register or the like as defined in claim 1 wherein the housing structure has a bottom plate over which the drawer slides, the end portions of the looped spring wire being at the rear and being attached to said plate, further characterized by means on said plate appurtenant to said end portions urging the looped spring wire to an upwardly inclined position as it extends forwardly from such attached end portions.

5. A toy cash register or the like as defined in claim 1 wherein the housing structure has a bottom plate over which the drawer slides, further charcterized in that the spring wire is looped to an incomplete generally circular form, the two ends of the wire constituting rear portions of the loop being secured to the bottom plate at laterally spaced positions, and means limiting projection of the drawer including an abutment portion on the bottom of the drawer movable in a path between said spaced ends during movement of the drawer.

6. A toy cash register as defined in claim 5 further characterized in that the loop lies in a generally horizontal position but is inclined upwardly in a forward direction from such rear portions.

7. A toy cash register as defined in claim 6 wherein when the drawer is closed and during the initial part of its opening movement the spring wire reacts against a forward portion of the drawer, which portion of the drawer moves entirely away from the spring wire during an inertia-induced overtravel of the drawer to the fully opened position, a sounding device fast with respect to the bottom plate and including a resilient arm stressable by an abutment portion on the drawer during an initial portion only of opening movement of the drawer, further characterized in that the arm and abutment portion are so positioned that stressing of the arm occurs prior to such overtravel.

8. A toy cash register as defined in claim 4 further characterized in that the spring wire is looped to an incomplete generally circular form, laterally spaced perforated ears extending upwardly from the bottom plate for attaching to said plate the two ends of the incomplete loop, the means for urging the spring wire to an upwardly inclined position comprising inclined surfaces on said ears, portions of the loop which diverge from said ends being urged against said inclined surfaces by the expansive force of the looped wire whereby the loop is yieldably urged toward an inclined plane perpendicular to the plane of said inclined surfaces.

9. A toy cash register as defined in claim 5 further characterized in that the spring wire is looped to an incomplete generally circular form, laterally spaced perforated ears extending upwardly from the bottom plate for attaching to said plate the two ends of the incomplete loop, the means for urging the spring wire to an upwardly inclined position comprising parallel inclined surfaces on said ears, portions of the loop which diverge from said ends being urged against said inclined surfaces by the expansive force of the looped wire whereby the loop is yieldably urged toward an inclined plane perpendicular to the plane of said ears and said inclined surfaces.

10. A toy cash register as defined in claim 7 further characterized in that the two abutment portions are defined by a single projection on the bottom of the drawer.

11. A toy cash register or the like as defined in claim 1 wherein two forward end portions of said looped spring wire are secured to and supported by the drawer and an intermediate unsecured rear portion thereof reacts against said housing structure.

12. A toy cash register including a housing defining a drawer compartment in a lower portion thereof and a mechanism compartment above the drawer compartment, a drawer slidable in the drawer compartment, and a horizontal partition defining a plane of segregation between said compartments and spaced above the drawer, characterized by a sounding device suspended by and beneath said partition in the space above the drawer, and means carried by the drawer for actuating the sounding device.

13. A toy cash register as defined in claim 12, including a drawer projecting spring looped to generally circular form and located under the drawer, further characterized in that the spring comprises an initially straight wire looped to circular form and which tends to straighten when relaxed, the two ends of the wire being attached to the bottom of the drawer at a forward position and an unsecured mid portion of the wire reacting rearwardly against the housing, the end portions reacting forwardly against the drawer.

14. A toy cash register according to claim 12, said means for actuating the sounding device including a striker for the sounding device movably supported by the beneath said partition, the means for actuating the sounding device comprising an abutment portion on an upper part of the drawer engageable with the striker during opening movement of the drawer.

15. A toy cash register according to claim 12 wherein said partition includes a sheet metal wall, a molded mechanism supporting member attached to the top of said wall, and means for suspending the sounding device beneath the wall including a supporting portion carried by said mechanism supporting member and extending downwardly through an opening in the wall.

16. A toy cash register according to claim 14 wherein said partition includes a sheet metal wall, a molded mechanism supporting member attached to the top of said wall, and means for suspending the sounding device and the striker beneath the wall including supporting portions carried by said mechanism supporting member and extending downwardly through openings in the wall.

17. In combination with means as defined in claim 16, means supporting said striker for swinging movement in a horizontal path to and from the sounding device, and for limited movement upwardly from said path, means biasing said striker horizontally toward the sounding device and vertically downwardly to the plane of said path, the abutment portion on the drawer having an abrupt side engageable with the striker during opening movement of the drawer to swing the striker away from the sounding device and having an inclined side engageable with the striker during closing movement of the drawer to cam the striker upwardly and permit the abutment to pass thereunder.

18. Means as defined in claim 14 wherein said striker is of generally U-shape having a supporting leg pivoted on a vertical axis in said partition and limitedly rockable in a vertical plane, a bight portion engageable with the sounding device, and a resilient retroflex spring arm having a free end spaced from the bight portion and from said axis and an abutment carried by the partition and engageable by the spring arm to stress the latter horizontally toward the sounding device when the striker is swung away from the sounding device.

19. Means as defined in claim 17 wherein said striker is of generally U-shape having a supporting leg pivoted on a vertical axis in said partition and limitedly rockable in a vertical plane, a bight portion engageable with the sounding device, said biasing means including a resilient retroflex spring arm having a free end spaced from the bight portion and from said axis, and an abutment carried by the partition and engageable by the spring arm to stress the latter horizontally toward the sounding device when the striker is swung away from the sounding device.

20. Means as defined in claim 19 wherein said last-mentioned abutment is also carried by said mechanism supporting member and extends downwardly through an opening in said wall.

21. Means as defined in claim 19 wherein said retroflex spring arm reacts upwardly against said partition to urge the bight portion downwardly to said horizontal path.

* * * * *

UNITED STATES PATENT AND TRADEMARK OFFICE

CERTIFICATE OF CORRECTION

PATENT NO. : 4,093,848

DATED : June 6, 1978

INVENTOR(S) : James E. Thomson

It is certified that error appears in the above-identified patent and that said Letters Patent are hereby corrected as shown below:

Column 3, line 65, after "springs" delete "35" and insert --fingers--

Column 3, line 67 after "and" delete "40"

Claim 14, Column 10, line 44, delete "the" (first occurence) and insert --and--

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*